US005226727A

United States Patent [19]

Reichner

[11] Patent Number: 5,226,727

[45] Date of Patent: Jul. 13, 1993

[54] AGITATOR/MIXER

[76] Inventor: Thomas W. Reichner, 1826 Warriors Rd., Pittsburgh, Pa. 15205

[21] Appl. No.: 767,388

[22] Filed: Sep. 30, 1991

[51] Int. Cl.[5] ..... B01F 7/02; B01F 15/02

[52] U.S. Cl. ..... 366/169; 366/265; 366/270; 366/279

[58] Field of Search ..... 366/262, 263, 264, 265, 366/270, 279, 154, 155, 169, 177

[56] References Cited

U.S. PATENT DOCUMENTS

| | | | |
|---|---|---|---|
| 2,530,814 | 11/1950 | DeBecze | 366/263 |
| 2,541,221 | 2/1951 | Edwards | 366/264 |
| 2,615,698 | 10/1952 | Valentine | 366/262 |
| 2,625,720 | 1/1953 | Ross | 366/262 |
| 2,875,897 | 3/1959 | Booth | 366/270 |
| 2,963,281 | 12/1960 | Reiffen | 366/270 |
| 3,953,004 | 4/1976 | Schmidt | 366/263 |
| 4,451,155 | 5/1984 | Weber | 366/265 |
| 4,499,562 | 2/1985 | Campolini | 366/264 |
| 4,592,658 | 6/1986 | Claxton | 366/265 |

FOREIGN PATENT DOCUMENTS

| | | | |
|---|---|---|---|
| 703282 | 2/1941 | Fed. Rep. of Germany | 366/265 |
| 828100 | 1/1952 | Fed. Rep. of Germany | 366/263 |
| 1083233 | 6/1960 | Fed. Rep. of Germany | 366/262 |
| 1155343 | 4/1958 | France | 366/262 |
| 1577661 | 8/1969 | France | 366/265 |
| 580103 | 7/1958 | Italy | 366/264 |
| 1474582 | 2/1967 | Italy | 366/262 |
| 187215 | 1/1964 | Sweden | 366/270 |
| 1286258 | 1/1987 | U.S.S.R. | 366/263 |
| 1318271 | 6/1987 | U.S.S.R. | 366/263 |
| 750197 | 6/1956 | United Kingdom | 366/262 |
| 757179 | 9/1956 | United Kingdom | 366/262 |
| 1358157 | 6/1974 | United Kingdom | 366/169 |

*Primary Examiner*—Philip R. Coe
*Assistant Examiner*—Randall Edward Chin
*Attorney, Agent, or Firm*—Armstrong, Westerman, Hattori, McLeland & Naughton

[57] ABSTRACT

A mixing device employs a rotating hollow column or pipe that is motor-driven for rotation, is open at both ends to, at its upper or outer end, receive an inflow of a mixing fluid, such a gas or liquid, and its opposite or lower end, to simultaneously receive a co-axial inflow of a fluid-like or flowable charge material that is to be thoroughly and substantially uniformly mixed with the counter in-flowing mixing fluid. A positive in-flow of the flowable material from a container, for example, is effected from the lower end of the device within the column, to combine with the in-flow of the mixing fluid and premix therewith in a swirling movement with respect thereto at an annularly open portion of the column and, as thus premixed, enter one or more annular out-flow chambers defined by spaced-apart disc assemblies which are being rotated to generate centrifugal force to finally complete the mixing of the materials and project them annularly radially outwardly therefrom, as into the container from which the flowable material is being drawn by reason of positive inward or suction pressure generated by a powered rotation of the column and its attached disc assembly or assemblies. Each disc or plate assembly may be shaped to provide a desired type and direction of outflow of the now fully mixed material from the outflow chamber or chambers back into the container from which fluid such as a liquid is being drawn.

6 Claims, 2 Drawing Sheets

AGITATOR/MIXER

This invention relates to an apparatus and two-stage procedure for initially coaxially mixing two different flowable materials and then finally mixing and projecting them in a fully mixed relation radially outwardly with respect to their axis of initial coaxial mixing. A phase of the invention relates to an improving apparatus and dual-stage, multi-directional procedure in which two materials to be mixed are co-axially moved towards each other along a confined mixing area and then are moved centrifugally outwardly therefrom in a fully mixed relation.

The operation involves first moving two different flowable materials axially into a counter mixing-commingling relation and then substantially radially outwardly with a rotation-induced increasing mixing force.

BACKGROUND OF THE INVENTION

There have been many devices for mixing flowable material such as liquids, including stirrers, paddle wheels and other rotatable motor-driven apparatus in which two or more materials to be mixed are placed in a container within which the materials are directly agitated. I have determined what the power requirements are for normal commercial quantities of materials to be fully mixed, such as in the paint, chemicals and other fluid processing industries.

OBJECTS OF THE INVENTION

It has been an object of my invention to develop a mixing device that at least approaches a portable type, that is of relatively simple construction, and that is highly efficient and capable of a substantial saving in energy requirements.

Another object has been to provide a stirring or mixing device that is easily mounted on a container, adaptable for mixing various materials and easily controlled for thoroughly mixing flowable charge materials and that, in operation, will involve a minimum of wear and tear on its operating elements.

A further object has been to provide a device that makes use of flow directional changes to permit the injection of and to maximize the commingling-mixing of flowable or fluid-like materials, such as liquids, gases, emulsions, powders, suspensions, etc.

These and other objects will be apparent to those skilled in the art from the specification, the drawings and the claims.

SUMMARY OF THE INVENTION

I have discovered that a relatively smooth but highly effective and complete mixing of flowable materials can be accomplished by, what may be termed, a two step procedure in which first step involves flowing one stream of fluid-like material into and axially along an enclosed column in one axial or longitudinal direction, while flowing a second stream of a different material in an opposite but coaxial longitudinal direction in the same enclosing column or hollow shaft and into a collision-mixing relation with each other at a central critical them. At such a swirling mixing and co-acting area, an annular or encircling mouth or orifice subjects the mixture to an annular or encircling suction force that is principally generated within a surrounding revolving chamber defined between at least a pair of spaced-apart rotating plates or discs. The centrifugal force thus produced then completes the mixing of the two fluidized streams and, at a suitable speed of the rotating discs, effects a continuous discharge of the mixture radially outwardly. In any event, the suction force generated by the rotating discs serves to draw fluid from the bottom of the tank or container into the preliminary mixing zone of the rotating column and disc assembly, and thereafter draw the preliminarily mixed fluid material into an encircling chamber or chambers defined between disc pairs. Finally, the then fully mixed fluid-like material is ejected in a patterned path annularly outwardly from the disc-defined chamber or chambers.

Figure 1:
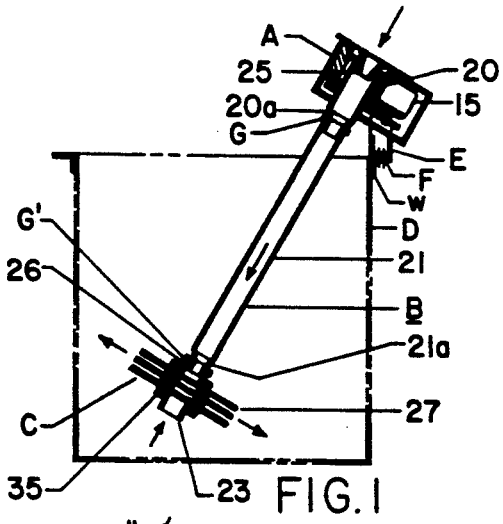
FIG. 1 is a vertical view in section and elevation showing a device, constructed in accordance with my invention that may be removably mounted in an angular relation on the rim of a container to extend into and process a fluid material therein.

And, FIGS. 10 to 14, inclusive, are fragmental sections on the scale of FIG. 1 illustrating different blade or disc shapes with the arrows showing patterns of mixed fluid outflow that are attained.

DETAILED DESCRIPTION OF THE DRAWINGS

Figure 8:
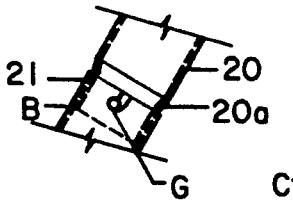
FIG. 8 is a fragmental section (slightly enlarged) showing a slot and pin assembly for the upper end of the hollow columns of FIGS. 1, and 2.

As shown in FIG. 1, I have provided a mixing device B which employs a longitudinal pipe or hollow fluid input column member 21 which, at its entry or upper end, see also FIG. 8, has a bayonet and socket fitting or pin and slot interfitting collar assembly G (see also FIG. 8) for removably detaching its motor drive unit A. An upper feed-in sleeve or drive collar 20 is rotatably driven by a variable speed electric motor 15 ( see also FIGS. 3 and 4) whose drive shaft 15*a* carries a pinion 18 that meshes with a gear 19 that is secured on a lower end portion of the motor-driven collar 20. A mounting housing, block or casting 10 carries a set of upper and lower bearings 22 to journal the drive collar 20 therein for rotation about a stationary uppermost feed-in collar 25. The drive unit A, as shown in detail in FIGS. 3, and 4 has a side and bottom sheet metal cover 11 that is removably secured by counter sun screws 13 on the block or casting 10. A top cover plate 12 is also removably secured by flat head bolts 13*a* on the casting 10, see FIG. 4. A lower end portion 20*a* of the upper drive collar 20 is shown in FIG. 8 as reduced in diameter to provide a bayonet and socket fitting G with the upper end of the longitudinal, upper or main column or tubing member 21.

Figure 4:
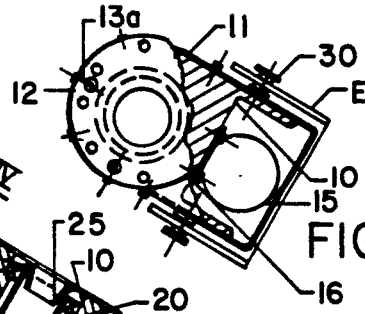
FIG. 4 is an enlarged view on the scale of FIG. 3 and taken along the line IV—IV of FIG. 3 with the cover for the motor drive assembly partially broken away.
Figure 3:
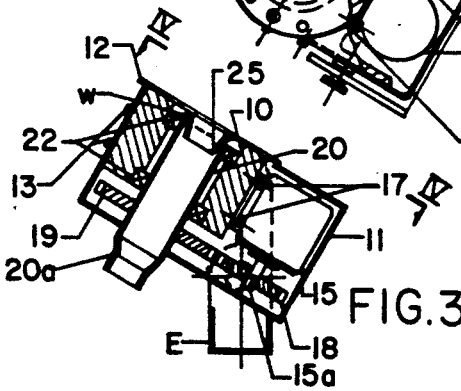
Figure 5:
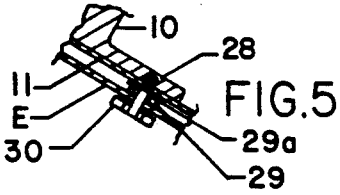
FIG. 5 is a slightly further enlarged fragmental view in section showing the hand wheel position-locking arrangement of the mounting bracket of the bearing motor drive assembly of the FIGS. 3 and 4.

A motor mounting bracket 6 for the drive unit is secured to the casting 10 by bolts 17 (see FIGS. 3 and 4). The entire motor drive unit A (see also FIG. 5) is adjustably mounted on the casting 10 by a pivoted bracket E, in order to permit an adjustment of its angular mounted position as well as of the hollow input column 21 of the entire mixing unit B to a desired inclined position with respect to a vessel or container D. In FIG. 5, a threaded stud 28 is shown mounted on the block 10 and a spacer collar 29 and washer 29*a* are interposed between mounting bracket E and a hand wheel nut 30 to, with the threaded stud 28, provide an adjustable mounting for each leg of the mounting bracket E, (see FIG. 1). The mounting bracket E may be bolted on an encircling channel or bracket F that is secured, as by weld metal w, about the mouth of the container D (see FIG. 1).

Figure 2:
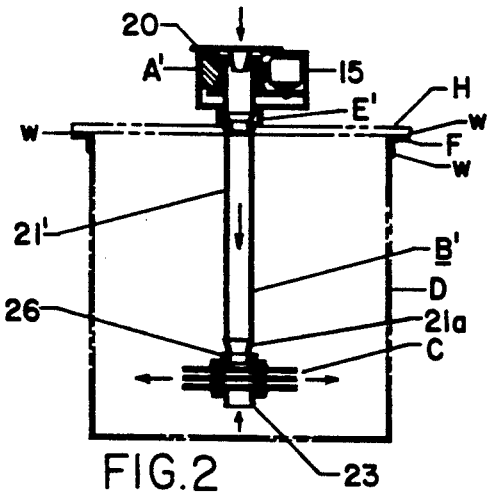
FIG. 2 is a vertical section on the same scale as FIG. 1 of a device of my invention which is to be mounted on cross mounted structural extending support over the top of a FIG. 3 is an enlarged vertical section showing the bearing and motor drive assembly of the upper end of the device of FIG. 1.

In the embodiment of FIG. 2, parts that are slightly modified but similar to those of FIG. 1 are designated by prime affixes. Hollow column member 21' is shown slightly shortened to facilitate its fully vertical positioning. Mounting bracket E' is shown of cup-like shape and may be bolted on a cross-extending frame member H that carries the motor unit A' and rests across the mouth of the container D. The member H may be bolted, or secured on the container bracket by one or more C-clamps (not shown). It will be noted that both of the mixing units of FIGS. 1 and 2 are detachably mounted on the container D in order to facilitate after-use cleaning of the container as well as the units.

Figure 9:
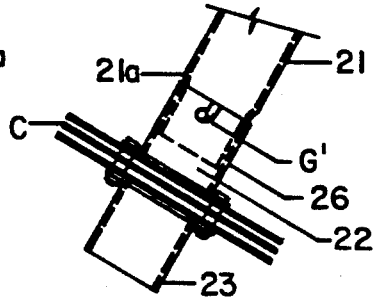
FIG. 9 is a fragmental section on the scale of FIG. 8 showing a slot and pin assembly for the lower end of the hollow columns of FIGS. 1, 2 and for the inner end of the shortened column of FIG. 6.
Figure 10:
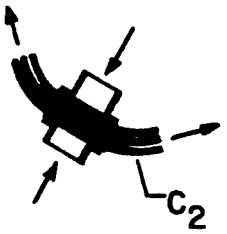
Figure 11:
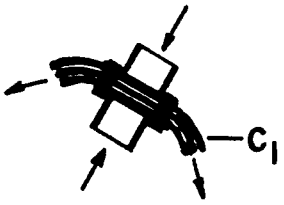
Figure 12:
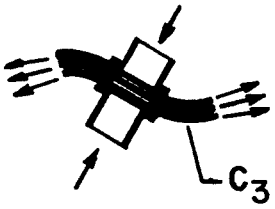
Figure 13:
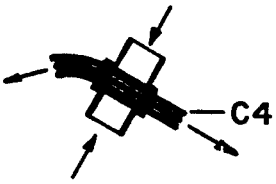
Figure 14:
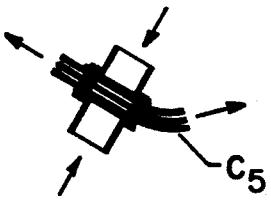

As shown in FIGS. 1 and 8 and previously indicated, the upper end of the column member 21 into which a fluid-like flowable mixing material is to be introduced has a detachable pin and socket fitted drive connection G with the lightly reduced inner end portion 20*a* of the motor-driven column 20. Also, a lower end portion 21*a* of column member 21, see FIGS. 1 and 9, is slightly reduced and has a detachable pin and socket fitted drive connection G' with a lowermost, relatively short length hollow column member or collar, which with a lowermost, relatively short length tubing hollow column member 23, provides a mounting for a mixer unit C.

Figure 7:
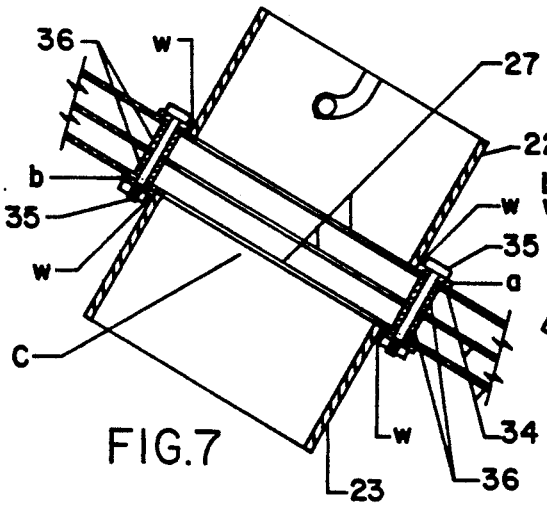
FIG. 7 is a greatly enlarged fragmental section (enlarged) showing a typical threaded bolt, nut and spacer mounting of chamber defining discs or plates of the constructions of FIGS. 1, 2 and 6
Figure 7A:
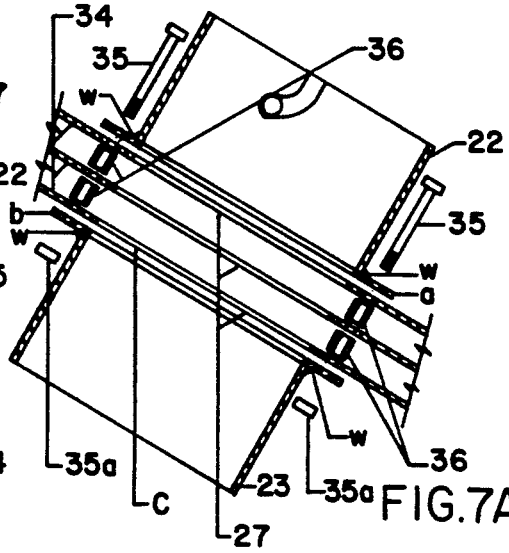
FIG. 7A is an exploded view of the same structure and on the same scale.

The mixer unit C, as, shown in FIGS 7 and 7A, is made up of a group of equally spaced-apart and parallel discs or plates 34 of circular shape, preferably a minimum of three in number, that are secured between flanges a and b about inner ends of the collar 22 and the short length lower column member 23 by through-extending pin-like bolt 35 and its nut 35*a* and spacer sleeve 36 assemblies. The column member 23 serves, under centrifugally induced suction force set up by rotation of the unit C, to upwardly withdraw fluid that is to be mixed from the content of the container D.

As shown in FIGS. 7 and 7A, spacer sleeve element 36 that, as shown extend through outer flanges a and b that are secured by weld metal w to project from inner end portions of the tubular, short length column members 22 and 23, are removable secured in position by nut 35*a* and bolt 35 assemblies in such a manner as to provide a strong unit for the hollow or fully centrally open, two chamber defining rotating disc assembly. This assmebly centrally defines a first and central mixing chamber for fluid being introduced inwardly or downwardly along the column 21 and fluid being drawn by suction inwardly or upwardly by suction through lower, shorter length column 23 from the fluid content of the container or vessel D. Each mixer unit C or $C_1$, etc. has a group of discs or plates, in an equally spaced relation that extends radially and annularly outwardly from a central, premixing, annular open mouth portion of the unit C or $C_1$ etc. to define final, processing-mixing chambers for fluids entering the upper 21 and lower 23 hollow columns in a co-axial counter flow relation. The two oppositely moving fluids are preliminarily mixed at an annular open banding area between the inner edges ends or 27 of the rotating discs 34 (FIG. 7) which, in effect, represents the area of jointure between socket part 2207 the upper column 21 and the lower column 23.

Figure 6:
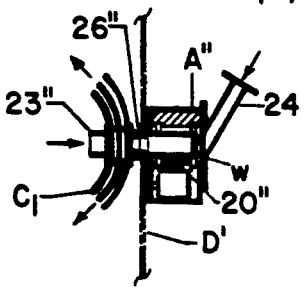
FIG. 6 is a vertical side section of a modified form of my device on the scale of FIG. 1, but constructed for horizontal mounting on a vertical sidewall of a container or tank.

FIG. 6 shows a modified type of unit that is adapted for mounting in a through-extending relation with respect to a sidewall of a container D' for fluids that are to be mixed. In this unit, the motor drive A" has a rotating entry collar 22 into which a fixed inclined feed chute 24 extends for feeding one fluid forwardly into an opposed relation on a horizontal axis with respect to container fluid being withdrawn by column member 23". The preliminary and final mixing is thus accomplished horizontally. This unit also employs the same principles as the units FIGS. 1 and 2, although it is not as efficient in its operational features. The chamber unit $C_1$, like the units $C_2$ to $C_5$, of FIG. 10 to 14, illustrate various shapes of blades that may be provided to accomplish desired outflow patterns of mixed fluids that may be attained employing principles of my invention.

I claim:

1. In a flow mixing portable device adapted to be mounted in an inwardly extending relation within a vessel having a flowable material content that is to be mixed with another flowable material being introduced therein which comprises, a lengthwise extending first hollow column member having an outer end and an inner end for, at said outer end thereof receiving the flowable material to be introduced and mixed with the flowable material in the vessel, a shorter length second hollow column member having an end, spacer means securing said inner end of said lengthwise extending first hollow column member in a coaxially spaced-apart aligned relation to said one end of said second hollow column member to define a radially-open first mixing chamber therewith, at least a pair of radially cross-extending discs mounted between said inner end of said first hollow column member and said one end of said second hollow column member to project in a substantially parallel and radially outwardly extending relation circumferentially around said radially-open first mixing chamber to define a circular outwardly extending flow of flowable material and a second mixing chamber that is directly radially open from the first mixing chamber for introducing and mixing flowable material from the second mixing chamber with flowable material in the vessel, a motor operatively mounted on said outer end portion of said first hollow column member for rotating said first and second column members to generate centrifugal force action in the spacing between said disc and suck-in flowable material from the vessel through said second hollow column member into the first mixing chamber and mix therewith the flowable material being introduced into the first mixing chamber from said inner end of said lengthwise extending first hollow column member and project the thus mixed flowable material radially outwardly under centrifugal force in a circumferentially extending relation from said second mixing chamber into and along the spacing between said discs into flowable material in the vessel.

2. An apparatus as defined in claim 1 wherein said discs are mounted on said spacer means.

3. An apparatus as defined in claim 2 wherein a plurality of said discs are mounted to project in a spaced-apart and parallel relation with respect to each other from said spacer means to project circumferentially radially outwardly from around said mixing chamber and define at least a pair of annular outwardly open centrifugal force generating outflow chambers.

4. An apparatus as defined in claim 2 wherein a hand wheel position-locking means is carried by said outer end of said first hollow column member for removably mounting the apparatus on the vessel.

5. In an apparatus as defined in claim 1 wherein said vessel has an upper end and a bottom portion said first hollow column member has means for mounting it and said motor on said upper end of the vessel to extend towards said bottom portion of the vessel.

6. An apparatus as defined in claim 1 wherein said discs have an outwardly radially projecting curvilinear shape to define a desired direction of radial outflow of mixed materials into the flowable material content of the vessel.

* * * * *